US010070228B2

(12) United States Patent
Wang et al.

(10) Patent No.: US 10,070,228 B2
(45) Date of Patent: Sep. 4, 2018

(54) BENDING LOUDSPEAKER AND WEARABLE ELECTRONIC PRODUCTS COMPRISING THE SAME

(71) Applicant: GOERTEK INC., WeiFang (CN)

(72) Inventors: Jingwei Wang, Weifang (CN); Ling Wan, Weifang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/315,350

(22) PCT Filed: May 19, 2015

(86) PCT No.: PCT/CN2015/079260

§ 371 (c)(1),
(2) Date: Nov. 30, 2016

(87) PCT Pub. No.: WO2015/184953

PCT Pub. Date: Dec. 10, 2015

(65) Prior Publication Data

US 2017/0201833 A1 Jul. 13, 2017

(30) Foreign Application Priority Data

Jun. 3, 2014 (CN) ..... 2014 1 0242847

(51) Int. Cl.
*H04R 9/06* (2006.01)
*H04R 7/04* (2006.01)
(Continued)

(52) U.S. Cl.
CPC ..... *H04R 9/06* (2013.01); *H04R 1/028* (2013.01); *H04R 7/04* (2013.01); *H04R 9/025* (2013.01); *H04R 7/12* (2013.01); *H04R 9/046* (2013.01)

(58) Field of Classification Search
CPC . H04R 9/06; H04R 7/04; H04R 1/028; H04R 9/025; H04R 9/046; H04R 7/12; H04R 7/122
(Continued)

(56) References Cited

U.S. PATENT DOCUMENTS

2006/0019719 A1* 1/2006 Son ..... H04M 1/0218 455/569.1
2011/0191941 A1* 8/2011 Chiang ..... A42B 1/245 2/209.13
2014/0064541 A1* 3/2014 Guenther ..... H04R 1/288 381/351

FOREIGN PATENT DOCUMENTS

CN 1725781 A 1/2006
CN 201821473 U * 5/2011
(Continued)

OTHER PUBLICATIONS

International Search Report for International Patent Application No. PCT/CN2015/079260 filed May 19, 2015.
(Continued)

*Primary Examiner* — Yogeshkumar Patel

(57) ABSTRACT

A bending loudspeaker and an electronic wearing product using same. The bending loudspeaker comprises a vibrating system, a magnetic circuit system and a shell (1), wherein the vibrating system comprises a vibrating diaphragm (2) having a bending shape and a voice coil (3) having a bending shape which is in matched combination with the vibrating diaphragm; the magnetic circuit system comprises a washer, a magnet and a speaker frame (8) having a bending shape from top to bottom, wherein the washer comprises a central washer (4) having a bending shape and side washers (5) having a bending shape which are arranged at two sides of the central washer (4) having a bending shape, and the magnets comprises a central magnet (6) having a bending
(Continued)

shape and side magnetic (7) having a bending shape which are arranged at two sides of the central magnet (6) having a bending shape.

9 Claims, 4 Drawing Sheets

(51) Int. Cl.

| | |
|---|---|
| ***H04R 1/02*** | (2006.01) |
| ***H04R 9/02*** | (2006.01) |
| ***H04R 7/12*** | (2006.01) |
| ***H04R 9/04*** | (2006.01) |

(58) Field of Classification Search
USPC ..... 381/423, 400, 430, 420, 184, 186, 333; 2/209.13
See application file for complete search history.

(56) References Cited

FOREIGN PATENT DOCUMENTS

| | | |
|---|---|---|
| CN | 203590436 U | 5/2014 |
| CN | 103997709 A | 8/2014 |
| CN | 103997710 A | 8/2014 |

OTHER PUBLICATIONS

Office Action from Chinese Patent Office for Application No. 201410242847.0 dated Jun. 12, 2017.
Office Action from Korean Patent Office for Application No. 10-2016-7028450 dated Apr. 19, 2017.

* cited by examiner

BENDING LOUDSPEAKER AND WEARABLE ELECTRONIC PRODUCTS COMPRISING THE SAME

CROSS-REFERENCE TO RELATED APPLICATIONS

The present specification is a U.S. National Stage of International Patent Application No. PCT/CN2015/079260 filed May 19, 2015, which claims priority to and the benefit of Chinese Patent Application No. 201410242847.0 filed in the Chinese Intellectual Property Office on Jun. 3, 2014, the entire contents of which are incorporated herein by reference.

TECHNICAL FIELD

The present disclosure relates to the technical field of acoustoelectric conversion, more particularly, to a bending loudspeaker and wearable electronic products comprising the same.

BACKGROUND ART

With social progress and economic development, in recent years, wearable electronic products such as wrist watch or intelligent glasses are becoming more and more, which has become a trend. There are higher performance requirements for these wearable electronic products, and thus, the shape of electronic parts, which match the wearable electronic products, are required to be in conformity with the shape of wearable electronic products.

Nowadays, in order to fit human body, most of wearable electronic products are designed with curved structures. However, currently, almost all the loudspeakers of the wearable electronic products are designed with flat-shaped structures, which may not be well fit to the wearable electronic products of curved shape when being assembled, causing space waste and difficulty in assembly.

Since the wearable electronic products are decreasing in size and becoming thinner, it is not allowed to generate assembly space waste in existing wearable electronic products, and thus, there is a need to provide a new kind of loudspeaker, so that the electronic part, such as the loudspeaker can be well fitted to the curve-shaped wearable electronic products.

SUMMARY OF THE INVENTION

Given the problems above, embodiments of the present invention are directed to providing a bending loudspeaker and wearable electronic products comprising the same, so as to overcome the drawbacks such as poor fit between the loudspeaker and the wearable electronic product to which the loudspeaker is applied, assembly space waste and difficulty in assembly.

According to an aspect, the present invention provides a bending loudspeaker, comprising a vibrating system, a magnetic circuit system and a shell; wherein, the vibrating system may include a bending diaphragm and a bending voice coil matching with and being coupled to the bending diaphragm;

the magnetic circuit system may include washers, magnets and a bending frame which are arranged sequentially from top to bottom;

the washers may include a bending central washer and a bending peripheral washer disposed at both sides of the bending central washer;

the magnets may include a bending central magnet and a bending peripheral magnet disposed at both sides of the bending central magnet;

the magnetic circuit system may be configured to drive the vibrating system, and the shell has a bending shape and is configured to correspondingly accommodate and fix the magnetic circuit system and the vibrating system.

Further, preferably, lateral projections of the bending diaphragm and the bending voice coil may have a same curvature.

Further, preferably, lateral projections of all parts of the bending loudspeaker may bend in a same arc direction and have a same bending curvature.

Further, preferably, the bending loudspeaker may further include a front cover; wherein, the front cover may have a bending shape and is correspondingly provided above the bending diaphragm; and the front cover and the diaphragm may have a same curvature. Further, preferably, a magnetic gap may be formed between the central magnet along with the central washer and the peripheral magnet along with the peripheral washer, and the voice coil may be accommodated in the magnetic gap.

Further, preferably, The voice coil may vibrate up and down. Cutting edges of the central magnet and the central washer at a side close to the magnetic gap and cutting edges of the peripheral magnet and the peripheral washer at a side close to the magnetic gap are also in the up-down direction, and the width of the magnetic gap from top to bottom remains the same Further, preferably, lateral projections of the voice coil and the magnetic circuit system may have a same curvature.

According to another aspect of the present invention, the present invention also provides a wearable electronic product, comprising a product housing and a bending loudspeaker which is assembled into the product housing, and the bending loudspeaker may be a bending loudspeaker as mentioned above.

Further, preferably, wherein lateral projections of the bending loudspeaker and the product housing may have a same curvature.

Further, preferably, a space formed between the front cover of the bending loudspeaker and the product housing may serve as a front acoustic cavity of the wearable electronic product, and the front acoustic cavity is in communication with outside;

a closed space formed between the shell of the bending loudspeaker and the product housing may serve as a rear acoustic cavity of the wearable electronic product.

From the above it can be seen that the bending loudspeaker according to the present application may have the following advantageous effects:

1) the bending loudspeaker may have an excellent fit with the wearable electronic product;

2) it is easy to perform the orientation and the assembly when assembling the bending loudspeaker into the wearable electronic product;

3) the bending loudspeaker may fit perfectly well with the wearable electronic product, thus saving the space of the cavity inside the wearable electronic product and facilitating the minimum design of the wearable electronic products; and 4) the bending loudspeaker may fit quite well with the wearable electronic product 10, and thus, when the cavity space inside the wearable electronic product 10 is in a fixed size, it may enable the maximum design of the loudspeaker, thus achieving the optimization of the structural and acoustic performances of the wearable electronic product.

In order to achieve the above and related objectives, one or more aspects of the present invention include features which will be described later and particularly indicated in the claims. The following description and the descriptions with reference to the drawings illustrate some exemplary aspects of the present invention in detail, and however, these are only some implementations of the various implementations which can use the principle of the present invention. In addition, the present invention is intended to include all the aspects and their equivalents.

BRIEF DESCRIPTION OF THE DRAWINGS

The above and other objects and advantages of the present invention will become more apparent and easy to be understood by the following descriptions with reference to the accompanying drawings and the claims and with a more comprehensive understanding of the present application, and in the drawings:

REFERENCE NUMERALS

1: shell;
2: diaphragm;
3: voice coil;
4: central washer;
5: peripheral washer;
6: central magnet;
7: peripheral magnet;
8: frame;
9: front cover;
10: wearable electronic product; and
11: product housing.

Throughout the drawings, same numerals indicate or represent same or similar features or functions.

DETAILED DESCRIPTION OF THE EMBODIMENTS

In the following description, for the purpose of illustration, many specific details are described so as to provide a comprehensive understanding of one or more embodiments of the present invention. However, obviously, the embodiments may be also implemented without these specific details.

Since the existing loudspeakers are designed in a flat shape without any arc, it may result in poor fit, assembly space waste and difficulty in assembly when this type of flat-shaped loudspeaker is assembled into the product.

In order to overcome the drawbacks, such as poor fit, assembly space waste and difficulty in assembly when assembling the loudspeaker into the wearable electronic products, the present invention provides a design structure of a bending loudspeaker in which the loudspeaker in its entirety and all its parts are designed in a bending shape, that is, the shell, the frame, the diaphragm, the voice coil, the magnets, the washers and the front cover are designed in bending shapes which are mutually corresponding and matching, and the loudspeaker which is assembled by these parts will be also in a corresponding bending shape. The bending loudspeaker may well fit the curve-shaped wearable electronic products and is easy to be assembled, which is beneficial to the minimum design of the wearable electronic products, and meanwhile can achieve the maximum design of the loudspeaker.

The specific embodiments of the present invention will be described in detail in conjunction with the following drawings.

Figure 1:
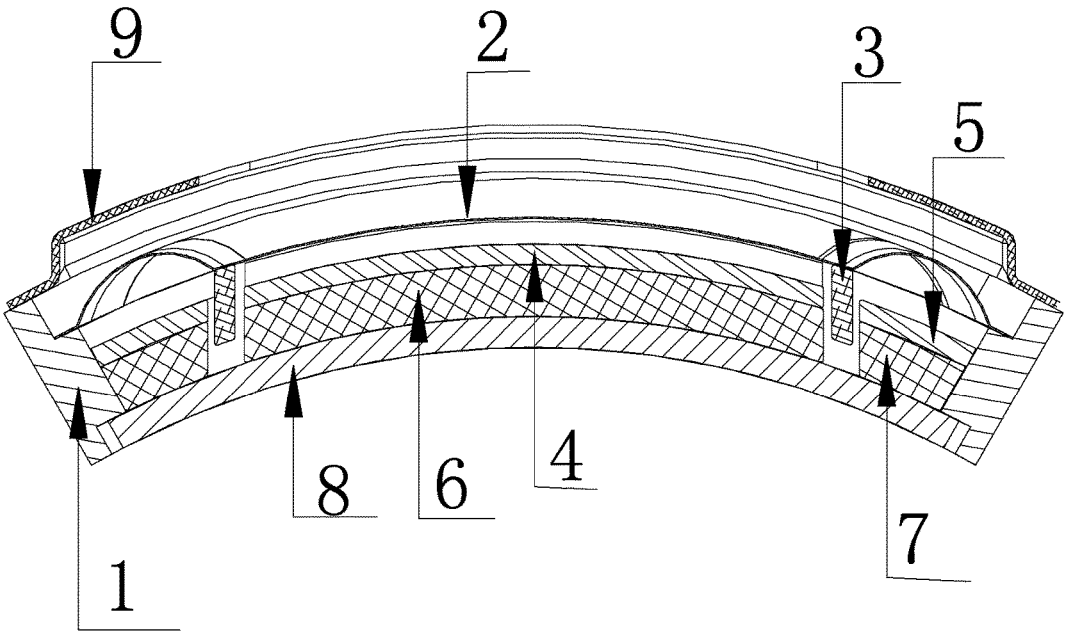
FIG. 1 is a schematic view illustrating a cross-sectional structure of a bending loudspeaker according to an embodiment of the present invention.
Figure 2:
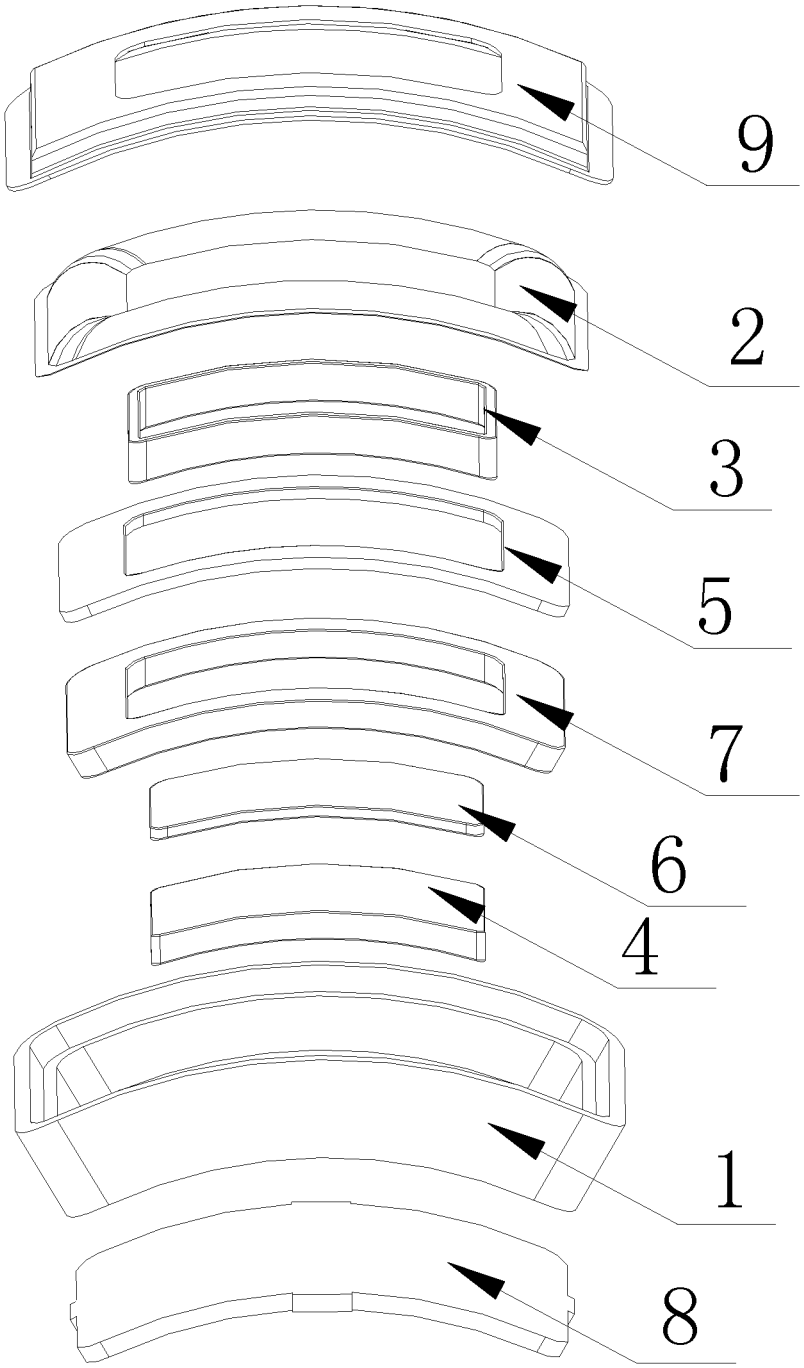
FIG. 2 is a schematic view illustrating an exploded structure of a bending loudspeaker according to the embodiment of the present invention.

FIG. 1 and FIG. 2 illustrate the cross-sectional structure and the exploded structure of the bending loudspeaker according to an embodiment of the present invention, respectively.

As illustrated in FIG. 1 and FIG. 2, the present invention provides a bending loudspeaker including a vibrating system, a magnetic circuit system and a shell 1.

Wherein the vibrating system may include a bending diaphragm 2 and a bending voice coil 3 which match with and is coupled to the bending diaphragm 2. The magnetic circuit system may be configured to drive the vibrating system, and the magnetic circuit system may include washers, magnets and a bending frame 8 from top to bottom. The washers may include a bending central washer 4 and a bending peripheral washer 5 provided at both sides of the bending central washer 4. The magnets may include a bending central magnet 6 and a bending peripheral magnet 7 provided at both sides of the bending central magnet 6. The shell 1 having a bending shape is configured to correspondingly accommodate and fix the magnetic circuit system and the vibrating system.

Further, it is important to note that lateral projections of the bending diaphragm 2 and the bending voice coil 3 have a same curvature, and a magnetic gap may be formed between the bending central magnet 6 along with the bending central washer 4 and the bending peripheral magnet 6 along with the bending peripheral washer 5, and the bending voice coil 3 may be accommodated in the magnetic gap. The bending voice coil 3 may vibrate up and down. Cutting edges of the bending central magnet 4 and the bending central washer 4 at a side close to the magnetic gap and cutting edges of the bending peripheral magnet 7 and the bending peripheral washer 5 at a side close to the magnetic gap are also in the up-down direction, and the width of the magnetic gap from top to bottom remains the same. The lateral projection of the voice coil 3 has a curvature which is the same as that of the magnetic circuit system.

That is, the bending voice coil 3 may be sleeved in the washers and the magnets, and the bending voice coil 3 may be provided between the bending central washer 4 and the bending peripheral washer 5, and meanwhile, the bending voice coil 3 may be provided between the bending central magnet 6 and the bending peripheral magnet 7.

Further, the bending loudspeaker may further include a front cover 9, wherein, the front cover 9 has a bending shape and is correspondingly provided above the bending diaphragm 2, and the front cover 9 may have a curvature which is the same as that of the diaphragm. Preferably, lateral projections of all parts of the bending loudspeaker may bend in a same arc direction and have a same bending curvature.

In the embodiment illustrated in FIG. 1, the diaphragm 2 may include a rigid dome portion at its central position and a suspension ring portion at its edge position. In the embodiment, the rigid dome portion at the central position and the suspension ring portion at the edge position are regarded as a diaphragm with an integral structure, and the lateral projection of the diaphragm with an integrated structure may have a bending curvature which is the same as that of the lateral projections of the other parts of the bending speaker.

In the present invention, besides the diaphragm (the diaphragm comprises the dome portion and the suspension ring portion, and the lateral projection of the diaphragm has a bending curvature which is the same that of the lateral projections of the other parts of the bending loudspeaker) illustrated in the embodiment as shown in FIG. 1, diaphragms with other shapes or structures may also be regarded as diaphragms with an integral structure, and the lateral projections of the diaphragms with an integral structure may also have a bending curvature which is the same as that of the lateral projections of the other parts of the bending loudspeaker. Since other parts of the diaphragm are known in the related art, their detailed descriptions are omitted here for avoidance of redundancy.

Figure 3A:
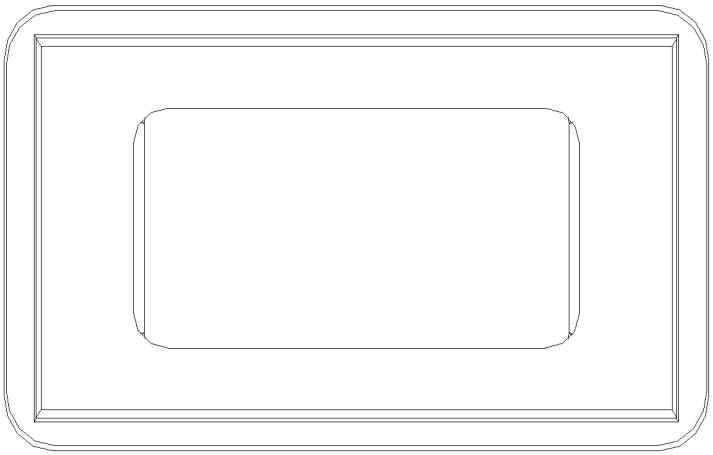
FIG. 3A, FIG. 3B and FIG. 3C are schematic views illustrating front view, lateral view and rear view of a bending loudspeaker according to the embodiment of the present invention, respectively.
Figure 3B:
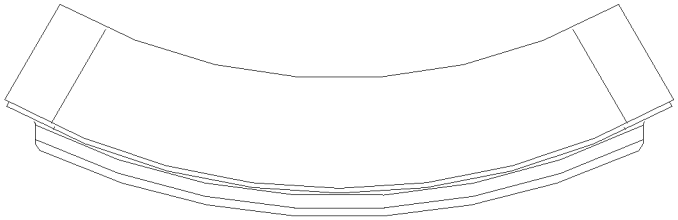
Figure 3C:
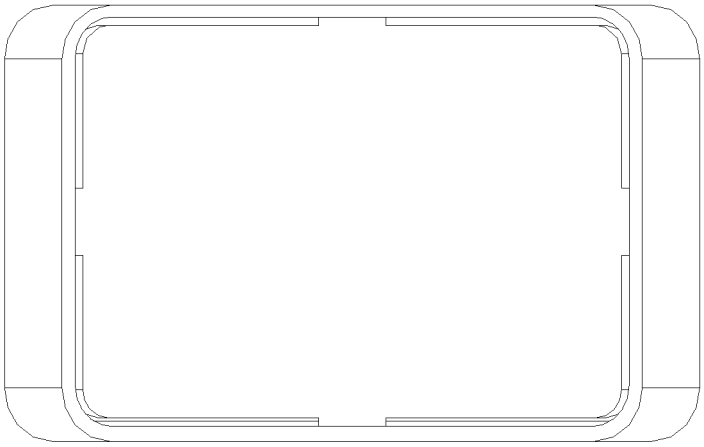

FIG. 3A, FIG. 3B and FIG. 3C illustrate front view, lateral view and rear view of the bending loudspeaker according to the embodiment of the present invention, respectively. It can be seen from the embodiment illustrated in FIG. 3A and FIG. 3C that the front projection and the rear projection of the bending loudspeaker may both have a rectangular shape; and it can be seen from the embodiment illustrated in FIG. 3B, the lateral projection of the bending loudspeaker may have a bending shape Thus, it can be seen from the embodiments illustrated in FIG. 1, FIG. 2, FIG. 3A, FIG. 3B and FIG. 3C that the whole bending loudspeaker according to the present application is designed in a bending shape, and meanwhile all parts of the bending loudspeaker, such as the shell, the diaphragm, the voice coil, the magnets, the washers and the frame and the like, may be all designed in a bending shape, that is, the lateral projections of all parts of the bending loudspeaker may bend in a same arc direction and have a same bending curvature.

Wherein it should be noted that the bending shell 1 may be configured to correspondingly accommodate and fix the bending magnets, the bending washers and the bending frame 8 of the magnetic circuit system and the bending diaphragm 2 and the bending voice coil 3 of the vibrating system, that is, all parts of the bending loudspeaker may have a same bending shape, and the bending arcs of all parts of the bending loudspeaker are corresponding to each other, and all parts of the bending loudspeaker have a same bending curvature. Thus, when assembling the parts into a loudspeaker, all the parts may be correspond to each other and match with each other extremely well so as to compactly assemble into a bending loudspeaker which can meet the demands of wearable electronic products having an arc structure.

The bending loudspeaker according to the present disclosure may be configured to be applied to the wearable electronic products, and since the wearable electronic products, such as smart watch or smart glasses, are designed to fit human body, most of wearable electronic products are designed with an arc structure so as to meet the demand of the body comfort of the user. Accordingly, the bending loudspeaker takes the arc structure of the wearable electronic products as the bending standard of the loudspeaker products, so as to overcome the drawbacks such as poor fit with human body due to the current loudspeakers with a flat-shaped structure, and maximize the utilization of the limited assembly space of wearable electronic products.

Figure 4:
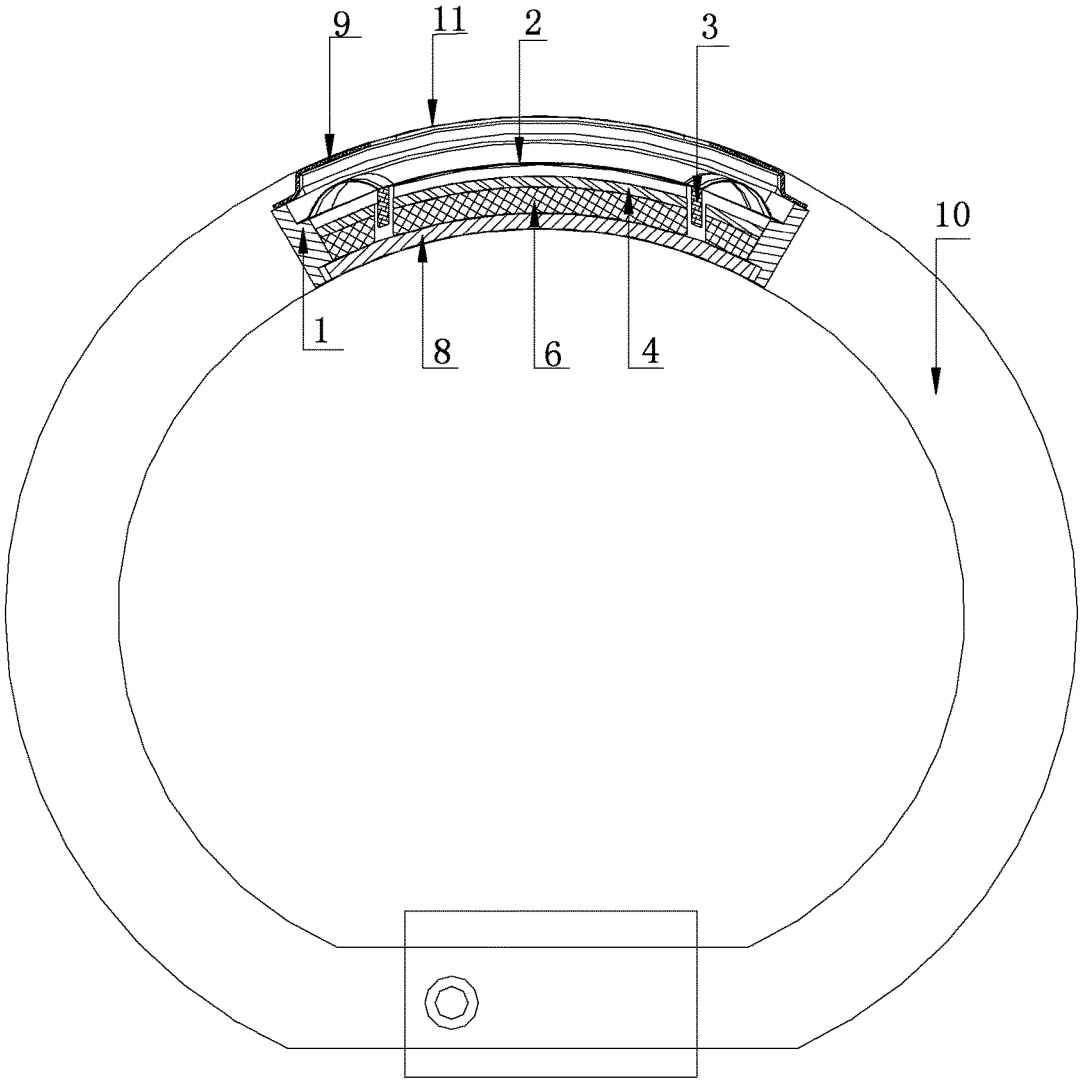
FIG. 4 is a schematic view illustrating an application structure of a bending loudspeaker according to the embodiment of the present invention.

FIG. 4 illustrates an application structure of the bending loudspeaker according to the embodiment of the present invention.

As illustrated in FIG. 4, the wearable electronic product provided by the present invention may include a product housing 11 and an above-mentioned bending loudspeaker which is assembled into the product housing 11. Wherein, the lateral projection of the bending loudspeaker may have a curvature which is the same as that of the lateral projection of the product housing 11.

That is, the bending arc of the product housing 11 and the bending arcs of all the bending parts of the bending loudspeaker which are assembled into the product housing 11 are corresponding to each other, and have a same bending curvature, which may facilitate the matching and the assembly during assembling process.

In the embodiment illustrated in FIG. 4, the wearable electronic product 10 has a round shape, and the whole bending loudspeaker according to the present invention may be assembled into the wearable electronic product 10. It can be seen from FIG. 4 that the bending arc of the bending loudspeaker and the bending arc of the round-shaped wearable electronic product 10 may be corresponding to each other and have a same curvature. Thus the bending loudspeaker may have an excellent fit with the wearable electronic product 10.

Further, it should be noted that compared with the conventional loudspeaker with a flat-shaped structure, the bending loudspeaker according to the present application may be easier to be positioned and assembled when the bending loudspeaker is assembled into the wearable electronic product 10, and meanwhile the assembly space may also be saved.

Since the wasting of the assembly space is an important problem to be solved when assembling the wearable electronic product and the loudspeaker, the bending structure of the bending loudspeaker according to the present invention may fit well with the arc structure of the wearable electronic product having an arc structure, thus saving a lot of assembly space.

Further, it should be noted that after assembling the loudspeaker into the wearable electronic product 10, the space formed between the front cover 9 of the bending loudspeaker and the product housing 11 of the wearable electronic product 10 may serve as a front acoustic cavity of the wearable electronic product, which is in communication with outside and transmits sounds produced by the loudspeaker to the outside. A closed space formed between the shell 1 of the bending loudspeaker and the product housing 11 may serve as a rear acoustic cavity of the wearable electronic product.

After assembling the bending loudspeaker into the wearable electronic product 10, the bending loudspeaker may fit perfectly well with the arc structure of the wearable electronic product due to its bending structure, thus maximizing the space saving of the cavity space inside the wearable electronic product 10 and facilitating the minimum design of the wearable electronic products 10.

This needs to be stressed that the wearable electronic products may have a function of decoration and need to be worn on human body, and thus, the wearable electronic products should fit well with human body and be convenient to wear, and when the smaller and the lighter the wearable electronic product is, the more suitable for wear the wearable electronic product will be. When the bending loudspeaker is applied to the wearable electronic products, the bending loudspeaker may save the cavity space inside the wearable electronic product 10, and be beneficial to the minimum design of the wearable electronic product, and may be beneficial to the wearing.

Further, it should be noted that when the bending loudspeaker is assembled into the wearable electronic product 10, the bending loudspeaker may fit quite well with the wearable electronic product 10, and thus, when the cavity space inside the wearable electronic product 10 is in a fixed size, the maximum design of the loudspeaker may be achieved; in other words, when the volume and size of the wearable electronic product 10 does not change, the loudspeaker, which is to be assembled into the wearable electronic product, has a bending structure, and the bending structure of the bending loudspeaker is designed to be exactly corresponding to the arc structure of the wearable electronic product 10, while such a designation approach may maximize the loudspeaker which is to be assembled into the wearable electronic product 10.

When the size of the cavity space inside the wearable electronic product is fixed, the larger the loudspeaker is, the better structural performance and acoustic performance the wearable electronic product may have. That is, when the size of the cavity inside the wearable electronic product does not change, the bending loudspeaker of the present invention may achieve the maximization of the loudspeaker according to the shape of the wearable electronic product, thus achieving the optimization of the structural and acoustic performances of the wearable electronic product.

It can be seen from the above embodiment that the bending loudspeaker having a bending shape according to the present invention may fit well with the bending wearable electronic product. When being assembled into the wearable electronic products, the bending loudspeaker may be easy to be positioned and be convenient to be assembled. When the bending loudspeaker is assembled into the wearable electronic product, it may save the cavity space inside the wearable electronic product and be beneficial to the minimum design of the wearable electronic product, and meanwhile when the size of the cavity space inside the wearable electronic product is fixed, the maximum design of the loudspeaker and the optimization of the structural and acoustic performances of the wearable electronic product may be achieved.

The bending loudspeaker and the wearable electronic product to which the bending loudspeaker is applied according to the present application have been described with reference to the drawings as above by way of an example. However, those skilled in the art should appreciate that various changes and improvements may be made to the above-described bending loudspeaker and the wearable electronic products to which the bending loudspeaker is applied according to the present invention without departing from the scope and spirit of the present invention. Thus, the protection scope of the present invention shall be defined by the appended claims.

The invention claimed is:

1. A bending loudspeaker applied in a wearable electronic product, comprising a vibrating system, a magnetic circuit system and a shell; wherein the vibrating system includes a bending diaphragm and a bending voice coil matching with and being coupled to the bending diaphragm;

the magnetic circuit system includes washers, magnets and a bending frame, which are arranged sequentially from top to bottom;

the washers include a bending central washer and a bending periphery washer provided at both sides of the bending central washer;

the magnets include a bending central magnet and a bending peripheral magnet provided at both sides of the bending central magnet; and the magnetic circuit system is configured to drive the vibrating system, and the shell has a bending shape and is configured to correspondingly accommodate and fix the magnetic circuit system and the vibrating system, wherein a bending arc of the bending loudspeaker and a bending arc of the wearable electronic product correspond to each other and have a same curvature, and wherein lateral projections of all parts of the bending loudspeaker bend in a same arc direction and have a same bending curvature.

2. The bending loudspeaker according to claim 1, wherein lateral projections of the diaphragm and the voice coil have a same curvature.

3. The bending loudspeaker according to claim 1, further comprising a front cover, wherein the front cover has a bending shape and is correspondingly provided above the bending diaphragm; and the front cover and the diaphragm have a same curvature.

4. The bending loudspeaker according to claim 1, wherein a magnetic gap is formed between the central magnet along with the central washer and the peripheral magnet along with the peripheral washer, and the voice coil is accommodated in the magnetic gap.

5. The bending loudspeaker according to claim 4, wherein the voice coil vibrates up and down, and cutting edges of the central magnet and the central washer at a side close to the magnetic gap and cutting edges of the peripheral magnet and the peripheral washer at a side close to the magnetic gap are also in an up-down direction, and width of the magnetic gap from top to bottom remains same.

6. The bending loudspeaker according to claim 1, wherein lateral projections of the voice coil and the magnetic circuit system have a same curvature.

7. The wearable electronic product, comprising:

a product housing; and the bending loudspeaker according to claim 1, which is assembled into the product housing.

8. The wearable electronic product according to claim 7, wherein lateral projections of the bending loudspeaker and the product housing have a same curvature.

9. The wearable electronic product according to claim 8, wherein a space formed between the front cover of the bending loudspeaker and the product housing serves as a front acoustic cavity of the wearable electronic product, and the front acoustic cavity is in communication with outside;

a closed space formed between the shell of the bending loudspeaker and the product housing serves as a rear acoustic cavity of the wearable electronic product.

* * * * *